United States Patent [19]

Kajinaga et al.

[11] 4,138,250

[45] Feb. 6, 1979

[54] METHOD FOR PRODUCING METAL BLOCK HAVING A HIGH DENSITY WITH METAL POWDER

[75] Inventors: Yoshihiro Kajinaga, Chiba; Ichio Sakurada, Ichihara; Shunji Ito, Chiba, all of Japan

[73] Assignee: Kawasaki Steel Corporation, Kobe, Japan

[21] Appl. No.: 741,349

[22] Filed: Nov. 12, 1976

[30] Foreign Application Priority Data

Nov. 18, 1975 [JP] Japan ..... 50-137744

[51] Int. Cl.[2] ..... B22F 1/00; B22F 3/16

[52] U.S. Cl. ..... 75/201; 29/420.5; 75/208 R; 75/223; 75/224; 75/226

[58] Field of Search ..... 75/226, 223; 29/420.5; 75/208 R, 224, 201

[56] References Cited

U.S. PATENT DOCUMENTS

| | | | |
|---|---|---|---|
| 3,361,599 | 1/1968 | Bargainnier et al. | 75/226 X |
| 3,474,516 | 10/1969 | Finlay et al. | 75/226 X |
| 3,671,230 | 6/1972 | Smythe et al. | 75/226 X |
| 3,741,756 | 6/1973 | Andersen et al. | 75/226 X |
| 3,899,821 | 8/1975 | Ito et al. | 75/226 X |

*Primary Examiner*—Richard E. Schafer

[57] ABSTRACT

A metal block having a high density can be easily obtained directly from metal powder by charging the metal powder in a metallic container, disposing carbonaceous powder through a partition plate on the metal powder so as to interrupt the metal powder from the air, uniformly heating the metal powder in the air together with the container and subjecting the metal powder in the air together with the container to a primary hot working and to a secondary hot working with or without effecting a uniform heating step.

11 Claims, 6 Drawing Figures

METHOD FOR PRODUCING METAL BLOCK HAVING A HIGH DENSITY WITH METAL POWDER

The present invention relates to a method for producing a homogeneous metal block having a high density from raw material powder consisting mainly of metal powder.

Heretofore, it has been proposed to produce a metal block having a high density from metal powder, for example, by the following methods.

1. Method of sintering and forging metal powder.
2. Method of hot compressing metal powder by hydrostatic pressure, and
3. Method of rolling metal powder.

However, in these methods, a reducing gas or inert gas atmosphere or a particular working machine is required, and the handling of the metal powder is troublesome. Moreover, in these methods, the production cost of the metal block is high and the productivity thereof is poor, and further the production of large size metal block is often difficult.

The inventors have already proposed a method, which has not the above described drawbacks of the conventional methods, in U.S. Pat. No. 3,899,821 (Japanese Laid Open application No. 38,612/75). In this method, the heating and hot working of metal powder can be carried out in the air and large size metal block can be produced. However, this method uses a shaped article obtained by previously compacting or sintering metal powder, and therefore the method has still such drawbacks that the handling of metal powder is troublesome, the production steps are complicated and the production cost of metal block is higher than the case where metal powder is directly worked.

In order to obviate these drawbacks, the inventors have variously investigated with respect to methods for producing metal block by hot working directly metal powder without previously forming the metal powder into a shaped article, and accomplished the present invention.

Therefore, it is an object of the present invention to provide a method, which is capable of heating and hot working directly metal powder in the air without oxidation of the powder.

Another object of the present invention is to provide a method for producing a homogeneous metal block having a high density directly from metal powder.

A further object of the present invention is to provide a method for producing a large size homogeneous metal block having a high density in a less expensive manner.

According to the present invention, a homogeneous metal block having a high density can be obtained by charging metal powder in a container and heating and hot working the powder in the air together with the container without the use of particular atmosphere and working machine.

A feature of the invention is the provision of a method for producing a metal block having a high density, comprising charging raw material powder composed mainly of metal powder and having a grain size of not larger than 1 mm in a metallic container; disposing carbonaceous powder through a partition plate on the raw material powder so as to interrupt the raw material powder from the air at the following heating steps; heating uniformly the raw material powder at a temperature from (M.P.×0.67)° C. to (M.P.−50)° C., wherein M.P. is a temperature, at which the raw material powder begins to melt, in the air together with the container; subjecting the above heated raw material powder to a primary hot working in the air together with the container to obtain a primarily hot worked compact body having a relative density of 64–96% based on the theoretical density of the raw material powder, in which the raw material powder is firstly compressed at a reduction ratio (the term "reduction ratio" means a ratio of the dimension of a material to be worked before a working to that of the material after the working in the pressing direction) of 1.5–2.0 without restricting the side walls of the container, to which pressure is not subjected (hereinafter, such side walls are abbreviated as "pressure-free side walls"), and successively the thus treated powder is compressed at a reduction ratio of less than 5.6 inclusive of the above described reduction ratio of 1.5–2.0 with restricting the pressure-free side walls; and subjecting the primarily hot worked compact body, with or without effecting said uniform heating step, to a secondary hot working together with the container, in which the primarily hot worked compact body is compressed at a reduction ratio of at least 1.5 or at a reduction of sectional area of at least 30%, to obtain a secondarily worked metal block having a relative density of 95–100% based on the theoretical density.

For a better understanding of the present invention, reference is taken to the accompanying drawings, wherein.

Figure 1:
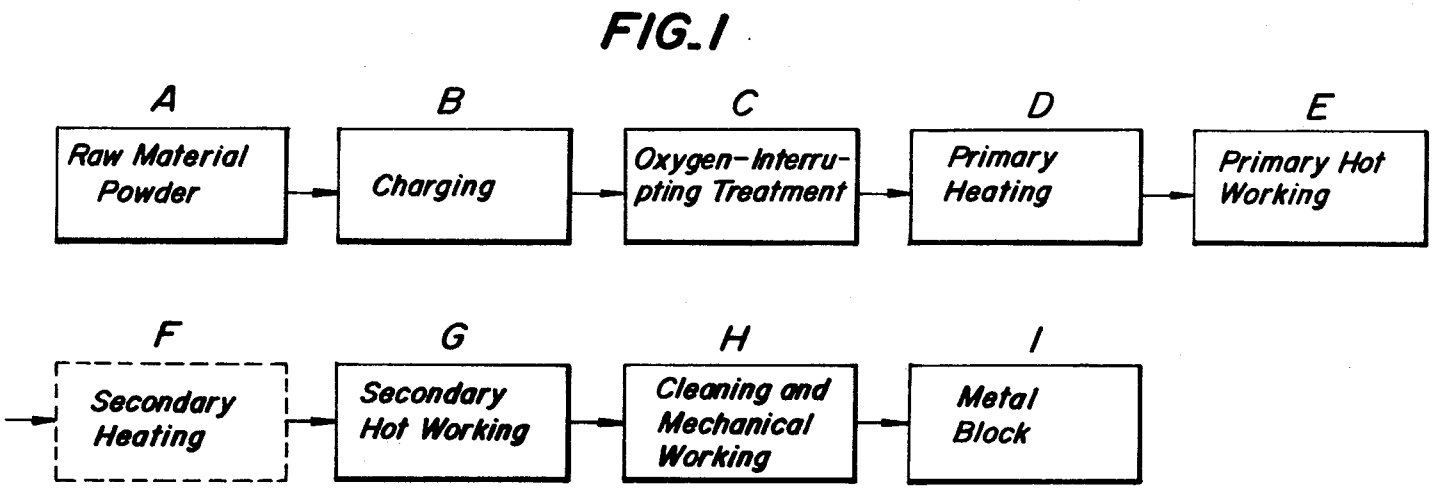
FIG. 1 is a flow sheet showing successive steps according to the present invention.

The present invention will be explained in more detail following to the steps shown in FIG. 1 with respect to the object and treating condition in the treatment in each step, particularly the reason of the limitation of the condition, and the working machine dies and tools to be used in the treatment.

RAW MATERIAL POWDER

In the present invention, metal powders, including metals, metal alloys and their mixtures can be used as a raw material. Further, mixtures of the metal powder and nonmetal powders, which amount is 0–10% by weight based on the amount of the mixture, can be also used as a raw material powder in the present invention. Because such mixtures also can be made into metal block having a high density. As one of the nonmetal powders, graphite powder is used and others are carbide, oxide, nitride and sulfide powders.

When the amount of nonmetal powder exceeds 10% by weight, the metal powders do not sinter tightly at the hot working, and many cracks occur in the resulting metal block, and densified metal block cannot be obtained. Therefore, the amount of nonmetal powders contained in the raw material powder must be at most 10% by weight.

The nonmetal material contained in the raw material powder may be present as a mixture with metal powders, or may be present on the surface or in the interior of the metal powder particles.

In the present invention, the particle size of raw material powder is very important. Powders having a large particle size cannot be uniformly mixed, and a homogeneous densified metal block cannot be obtained, and further many cracks are apt to occur in the resulting metal block during the working. Therefore, it is necessary to use fine raw material powder having a particle size of not larger than 1 mm. However, when powder having an extremely fine particle size is used, the powder must be compressed in a primary hot working at a reduction ratio of not less than 5.6 in order to obtain a primarily hot working compact body having a predetermined relative density, and the extremely fine powder cannot be formed into a metal block of high density in the method of the present invention. When a primary hot working is carried out at a reduction ratio of not less than 5.6, the container is broken and cracks occur in the hot worked compact body. Therefore, the extremely fine powder cannot be used in the present invention.

STEP FOR CHARGING RAW MATERIAL POWDER

A container for receiving raw material powder and the charging method of the powder in the container can be freely selected so that the object of the present invention can be attained, and are not particularly limited.

A container made of metal is used so that hot working of raw material powder can be carried out in the air. The metal of the container may be any material which can endure the hot working. Further, the shape of the container, the production methods thereof (for example, welding, draw forming and pressure bonding) and the wall thickness thereof can be freely selected depending upon the kind of powders to be charged in the container, the method of hot working, the dimension and shape of the aimed metal block, and the production cost and easiness in the working of the metal block, and are not particularly limited.

The metallic container to be used in the present invention plays the following roles that the container holds the raw material powder therein, that the interior of the container is kept under a reducing atmosphere to prevent the raw material powder from being oxidized by the air at the heating, and that the raw material powder is restricted by the side walls of the container during hot working.

Raw material powder can be charged in the container in any methods, such as natural charging, tap charging, vibration charging, compression charging under a low load and the like. When raw material powder is a mixture, it is necessary to take care of the segragation of particles. Most of raw material powders having particle size of not larger than 1 mm have a relative density of 19–57% based on the theoretical density, and greater part of the powders have a relative density of 29–43%. However, very fine powders having a particular shape occasionally have relative density of lower than 19%.

STEP OF OXYGEN-INTERRUPTING TREATMENT BY MEANS OF CARBONACEOUS POWDER

This step is adopted in order that a hot working for the raw material powder charged in a metallic container can be carried out in the air, and is very important in the present invention.

As a method for preventing the oxidation of raw material powder in a container, there has been known a method disclosed, for example, in the Japanese Laid Open application Nos. 103,521/72 and 64,617/73, wherein the container is sealed tightly after the evacuation into vacuum. However, this method has such drawbacks that the handling of the container is troublesome and the raw material powder is not reduced due to the fact that open air is completely shut out from the powder. Moreover, this method is not suitable for the mass production of metal blocks and is not economic.

On the contrary, according to the method of the present invention, carbonaceous powder is interposed between raw material powder and the air to interrupt the powder from open air. Therefore, oxygen contained in the air is introduced into the container at high temperature heating after converted into carbon monoxide, whereby the interior of the container is always kept to a reducing atmosphere. As the result, not only the raw material powder in the container is prevented from being oxidized, but also the powder is rather reduced to decrease the oxygen content.

The kind of carbonaceous powder, which can be used as an oxygen-interrupting agent, and how to use the powder will be explained hereinafter.

In the present invention, any carbonaceous powders containing at least about 50% by weight of fixed carbon can be used, and can prevent fully the oxidation of raw material powder. Carbonaceous powder having a particle size of not larger than about 1 mm is easy in the handling and can convert efficiently oxygen in the air into carbon monoxide at the burning. However, the amount of fixed carbon and the particle size are not particularly limited, and any kinds of so-called carbonaceous powders can be used.

In general, natural graphite powder having a low sulfur content is advantageously used. In addition to such carbonaceous powder, metal powders, which are oxidized more easily than raw material powder, may be used as a catcher for oxygen. However, the use of such metal powders is not preferable due to the reason that such metal powders are expensive and often fail to interrupt oxygen completely. That is, the metal powder burns at a rate higher than the burning rate of carbonaceous powder, and does not gasify by the burning, so does not form a reducing atmosphere contrary to carbonaceous powder. Therefore, when the metal powder is used as a catcher for oxygen, it is necessary to use in a large amount. Moreover, the metal powder is not so effective.

Based on the above described reason, the oxygen-interrupting agent is limited to carbonaceous powder in the present invention.

One of the important points in the use of carbonaceous powder is that the contact of the carbonaceous powder with the raw material powder, or the incomplete mixing thereof must be absolutely prevented. When such contact or incomplete mixing once occurs, the raw material powder in the contacted portion or incompletely mixed portion melts or hardens due to the formation of carbides or carburized layers. As the result, cracks occur in a compact body during the hot working, and a finally worked metal block will be broken.

Accordingly, in the present invention, carbonaceous powder is disposed in a particular method so that the powder can be always isolated from raw material powder and can serve as an antioxidant. Two methods are adopted in the disposing of carbonaceous powder in the present invention. The one is a method, wherein carbonaceous powder is disposed in the inside of a container, and the other is a method, wherein carbonaceous powder is disposed at the outside of a container. These methods will be explained in more detail hereinafter.

Another important point in the use of carbonaceous powder is to prevent the powder from being rapidly burnt up during the heating or hot working of raw material powder charged in a container.

In order to prevent such phenomena, it is necessary to select properly the size and number of gas holes formed through a cover of a container and the amount of carbonaceous powder to be used. It has been found from the results of experiments that a good result is obtained, when the gas holes are formed close to the center of a cover as possible and the total sum of the area of the gas holes is not larger than 10% based on the inner cross-sectional area of a container.

The number, shape and arrangement of gas holes can be selected freely. However, gas holes must be positioned just above carbonaceous powder portion in the case where the powder is disposed in the inside of the container, or just below carbonaceous powder portion in the case where the powder is disposed at the outside of the container.

The gas holes serve to introduce carbon monoxide generated in the carbonaceous powder portion into the container at the heating, and to exhaust gases present in the interior of the container to the exterior of the container at the primary and secondary hot workings. According to the present invention, gases present in the interior of the container are squeezed out during the hot workings, whereby raw material powder can be easily formed into a densified metal block.

One of the features of the present invention is that the container is not tightly closed, and such structure is very important in the method of the present invention.

The amount of carbonaceous powder to be used will be explained. When carbonaceous powder is disposed in the inside of a container in such a manner that the powder is not in direct contact with raw material powder by a partition plate, the height of the disposed carbonaceous powder must be within the range of 1/100–1/20 based on the height of the container, and the area of the disposed carbonaceous powder must be within the range of 5–65% based on the inner cross-sectional area of the container. The lower limits of the thickness and area of disposed carbonaceous powder are lowest amounts necessary for preventing the carbonaceous powder from being burnt up during the heating. While, the upper limit thereof are largest amounts necessary for preventing the contact of the raw material powder with the carbonaceous powder or the incomplete mixing thereof during the hot working.

When carbonaceous powder is disposed at the outside of a container, the lowest necessary amount is the same as the amount used in the case where the powder is disposed in the inside of the container, but the upper limit of the amount is not particularly limited. Because, since a metallic cap charged with carbonaceous powder is arranged at the outside of a container, the dimension of the cap can be freely to selected. Moreover, since the cap can be removed together with carbonaceous powder just before the hot working, the contact of carbonaceous powder with raw material powder and the incomplete mixing thereof do not occur at all. However, the use of an excessively large amount of carbonaceous powder does not more increase the effect, and therefore the amount of carbonaceous powder to be disposed at the outside of the container should be properly selected referring to the case where the powder is disposed in the inside of the container.

The interior of the container is kept under a reducing atmosphere by the use of carbonaceous powder as described above. As the result, formation of a large amount of carburization of raw material powder does not substantially occur.

PRIMARY HEATING STEP

The primary heating step is carried out in order to heat uniformly raw material powder in the air together with a container charged with the powder, and is necessary in order that the powder charged in the container is formed into a compact body having a high density in the following primary hot working step. The lowest temperature of the uniform heating for raw material powder in this step is (M.P.×0.67)° C., wherein M.P. is a temperature, at which the raw material powder begins to melt. When a hot working is started at a temperature of lower than the above described temperature, the metallic container is apt to be broken due to the lack of the plastic deformability, and the raw material powder in the container is oxidized and cracks occur in the finally worked metal block. Moreover, raw material powder itself is poor in the hot-compressibility at such low temperature, and therefore a high pressure is required in the primary hot working in order to obtain a primarily hot worked compact body having a predetermined density, and the working machine, die, roll, etc. are subjected to overload. Moreover, when the capacity of the working machine is limited, the production of a large size metal block is difficult. Therefore, the lowest temperature in the primary heating must be (M.P.×0.67)° C.

While, the highest temperature in the primary heating is determined from the view point of uniform heating for raw material powder. That is, even when raw material powder charged in a relatively small container is gradually heated and kept at a predetermined temperature for a long period of time to heat uniformly the powder, the fluctuation of the temperature is as large as about 50° C. Therefore, the highest heating temperature in the primary heating must be (M.P.−50)° C. in order to prevent local melting of raw material powder.

Furthermore, when a part of raw material powder is melted, large cavities having a irregular shape are formed, and the raw material powder can only in a difficult manner be worked into a dense metal block in the following hot workings, and further cracks and unevenness in density occur in the finally worked metal block. Moreover, the raw material powder is solidified and segregated at the melted portion. In order to obtain the homogeneous metal block aimed in the present invention, the melting of raw material powder must be prevented.

Further, in order to obtain a primarily hot worked compact body having a higher density, the primary heating is preferably carried out at a temperature from (M.P.×0.80)° C. to (M.P.−50)° C.

The time necessary for heating uniformly raw material powder in the primary heating varies depending upon the kind, weight and charging density of raw material powder, the kind, weight and wall thickness of a container, and the heating capacity of a furnace. Therefore, it is difficult to determine a proper heating time. However, when temperature is raised step by step, the time necessary for uniform heating of raw material powder at a predetermined temperature can be shortened.

Any kinds of heating furnaces can be used, and gas furnace, heavy oil furnace, electric furnace, induction furnace and the like are properly selected by taking into consideration the property of raw material powder and the working cost.

PRIMARY HOT WORKING STEP

In the method of the present invention, raw material powder is not directly made into a high density metal block (a metal block having a theoretical density or having a density nearly equal to the theoretical density, hereinafter referred to as high-density metal block) by only one step of hot working, but raw material powder is once hot worked into a compact body having an intermediate density, and then the compact body is again hot worked by a conventional method, such as forging, rolling and the like, to produce a high-density metal block. That is, in the method of present invention, plural hot working steps are adopted, and a step for working raw material powder into a compact body having an intermediate density is called as a primary hot working step, and a step for working the compact body into a high-density metal block by the above described conventional method is called as a secondary hot working step.

According to the method of the present invention, which consists of plural hot working steps, a high-density metal block can be produced more easily than the conventional method of obtaining dense powder, wherein the metal block is directly produced by only one step of hot working, and particularly a large size metal block can be advantageously produced. That is, when it is intended to produce a high-density metal block directly from raw material powder by only one step of hot working, a very high working pressure is required, and dimension of the metal block is limited from the strength of die and the capacity of working machine to be used. The inventors have made various experiments in order to obviate the drawbacks and developed the two-step hot working method of the present invention.

The primary hot working step also is carried out in the air together with the container.

The primary hot working has two objects. The one is that raw material powder is compressed under a pressure of as low as possible in order to obviate the limitation in the working dimension due to the ability of working machine. The other is that raw material metal powder is compressed to a certain degree and to obtain a compact body capable of being subjected to a secondary hot working.

In order to attain these objects, the ratio of the density of the primarily hot worked compact body to the theoretical density thereof is limited to within the range of 64–96%. That is, the lower limit value of 64% is the lowest relative density necessary for preventing the breaking down of the compact body and the formation of cracks in the compact body at the secondary hot working. While, the upper limit value of 96% is a relative density which can be attained under a relatively low pressure in the primary hot working.

Figure 2:
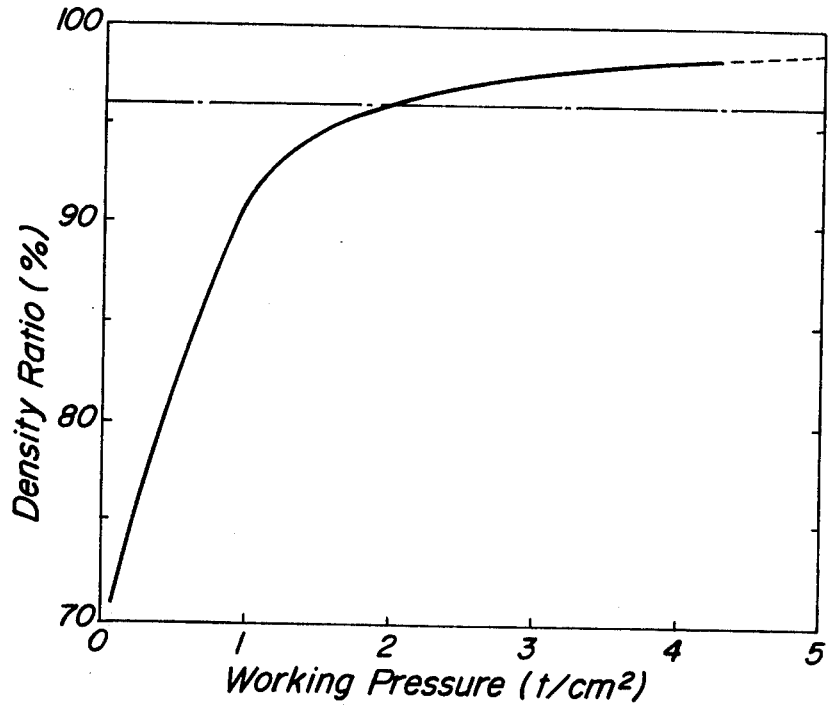
FIG. 2 is a graph showing a relation between the pressure in the primary hot working of alloy steel powder and the relative density of the primarily hot worked compact body.

FIG. 2 shows the variation of the relative density of a compact body produced from alloy steel powder (0.4% C-1% Cr) having a large deformation resistance in function of working pressure of the primary hot working step according to the present invention. It can be seen from FIG. 2 that about 2 t/cm$^2$ of pressure is required in order to obtain a compact body having a relative density of 96%. Therefore, when the above described alloy steel powder is subjected to a primary hot working by means of a 10,000 ton press, which probably has a highest ability among commonly used working machines, a theoretical cross-sectional area to be pressed is at most 5,000 cm$^2$, and it is impossible that a container with metal powder, whose cross sectional area to be pressed is larger than 5,000 cm$^2$, is compressed to a compact body having a relative density of 96%. It has been found that a pressure of about 0.05–2 t/cm$^2$ is required in order to compress raw material powder into a compact body having a relative density of 64–96%.

Then, an explanation will be made with respect to dies or rolls necessary for the primary hot working and to compression methods. In the primary hot working, a container with powder enclosed in the die is worked. Therefore, it is difficult that raw material powder is directly worked into a compact body having a high density through free working system, such as free forging or free rolling (the free working means a working which does not restrict side walls of a container with raw material powder, parallel to the compression direction). That is, in the free working system, even when walls of container are present, the walls cannot completely restrict the pressure-free side surfaces of raw material powder, and therefore the raw material powder flows to the pressure-free direction, and as a result it is difficult to work the raw material powder into a compact body having a high density, and cracks occur in the compact body.

Therefore, it is necessary to restrict the pressure-free side walls of a container with raw material powder. As the method for this restriction, there may be advantageously used a conjugate type die having cavities in the forging or in the press working, and a caliber roll in the rolling. The present invention is designed so as to restrict the pressure-free side walls of a container with raw material powder only at the latter half of the primary hot working step.

The above described restriction system is very important in the present invention, and is one of the features of the present invention. However, the working system used in the primary hot working of the present invention is a compression which is mainly carried out in a uniaxial direction, and a relative compression in the lateral direction due to the restriction by the pressure-free side walls is only carried out slightly in the latter half of the primary hot working. Therefore, the pressure applied to the restricting surface of the die and roll is relatively low. This fact can be understood from the fact that the pressure applied to raw material powder in the primary hot working is relatively low as described above.

The working system in the primary hot working will be explained in more detail. The first half of the primary hot working is a free working system, in which pressure-free side walls of a container with raw material powder are not restricted. The first half is carried out in a reduction ratio of 1.5–2.0.

That is, in the first half of the primary hot working, the working proceeds mainly by a compression applied in a uniaxial direction such that the pressure-free side walls of a container with raw material powder are not brought into contact with the restricting surfaces of a die or a roll. Following to the free working in the first half of the primary hot working, the compact body obtained in the first half of the working is further worked in the latter half of the hot working at a reduction ratio of less than 5.6 inclusive of the reduction ratio in the first half of the working, under such condition that the pressure-free side walls of a container with raw material powder are restricted, that is, the contact area between the pressure-free side walls and the restricting surfaces of a die or a roll are gradually increased.

In this latter half of the primary hot working, the compression in a uniaxial direction is mainly carried out, and the amount of raw material powder elastically moved in the pressure-free direction is relatively small.

As described above, one of the features of the present invention also lies in that the first half of the primary hot working is carried out in a free working system and the latter half thereof is carried out in a restricted working system.

Fin portions formed at the central portions of the pressure-free side walls of the container in a direction perpendicular to the pressing direction will be cut off after all of working steps are finished.

Then, an explanation will be made with respect to the reason of the limitation of reduction ratio in the primary hot working step.

When a free working in the first half of the primary hot working step is carried out at a reduction ratio of less than 1.5 and then a restricted working is carried out in the latter half thereof, thick fin portions are formed on the side walls of a container with raw material powder during the restricted working, and a part of the raw material powder moves to the fin portions and is kept under a non-restricted state, and as the result cracks occur in the fin portion of the compact body during the secondary hot working.

While, when the free working in the first half of the primary hot working is carried out at a reduction ratio of more than 2.0, the pressure-free side walls of a container are not sufficiently restricted, and a primarily hot worked compact body in these portions has a relative density of less than 64%, and cracks occur in these portions of the compact body during the secondary hot working also.

As described above, in the present invention, the first half of the primary hot working must be carried out at a reduction ratio of 1.5–2.0. It is important in the present invention to adjust properly the relation between the dimension of a container and that of a die or a roll so that the first half of the primary hot working can be carried out at the above described reduction ratio.

While, the restricted working in the latter half of the primary hot working must be carried out at such a reduction ratio of less than 5.6 inclusive of the reduction ratio in the first half of the working. The reason is that, when the reduction ratio is not less than 5.6, the container is broken and cracks occur in the compact body.

It is preferable that the total reduction ratio in the primary hot working is 2.3–3.2 inclusive of the reduction ratio in the first half and that in the latter half of the working.

The primary hot working step may be divided into 3 or more stages, in which dies and caliber rolls, whose dimension and shape are different step by step, are used. Further, a die having a tapered height or a tapered width may be used, so that partial working may be proceeded from one end of a container with raw material powder to the other end thereof.

A supplementary explanation will be made with respect to the primary hot working step, in which a cap charged with carbonaceous powder is fixed to the outside of a container. In this case, the working itself is exactly the same as the case where carbonaceous powder is disposed in the inside of a container. However, it is desirable to remove the cap charged with carbonaceous powder together with the carbonaceous powder just before the primary hot working.

That is, raw material powder in the container is very little oxidized during the hot working as compared with the oxidation of the powder during the heating, and so it is advantageous to carry out the primary hot working without the cap which is obstructive in the hot working. The hot working without cap is advantageous also in the secondary hot working, which will be explained later.

SECONDARY HEATING STEP

The secondary heating step is carried out prior to the secondary hot working step. This step is not essential in the present invention, and is carried out, if necessary. That is, when the temperature of a primarily hot worked compact body is high enough to carry out directly a secondary hot working of the body and further primary and secondary hot working machines can be used in parallel, the secondary heating step may be omitted. However, when the temperature of a primarily hot worked compact body is too low to carry out directly a secondary hot working of the body, the body must be uniformly heated similarly to the uniform heating in the primary heating step. Of course, the heating may be carried out in the air, and the heating time is the same as that in the heating of an ordinary product produced from ingot metal.

When the air-interrupting system is adopted wherein a cap charged with carbonaceous powder is fixed to the outside of a container, it is desirable that the secondary heating is carried out after a cap charged with carbonaceous powder is fixed to the outside of the container.

SECONDARY HOT WORKING STEP

The secondary hot working step also is carried out in the air. This secondary hot working is carried out in order that a primarily hot worked compact body having a relative density of 64–96% is further made into a finally worked metal block having a high density and sufficiently high strength and toughness by a free working system.

The secondary hot working is carried out by forging, rolling or other methods similarly to the working of an ordinary product produced from ingot metal. The secondary hot working is generally carried out by a free working system, but in a particular case, a restricted working system may be carried out by the use of a die or a caliber roll.

The primarily hot worked compact body is subjected to the secondary hot working at a reduction ratio of at least 1.5 or at a reduction of sectional area of at least 30% to obtain a finally worked metal block having a relative density of 95–100% based on the theoretical density. The lower limit of the relative density of the finally worked metal block means a lowest value necessary in the finally worked metal block having sufficiently high strength and toughness.

When the secondary hot working is carried out by a free working system, a large amount of plastic deformation occurs generally in the lateral direction in the compact body, and a finally worked metal block having a high density and desired dimension and shape can be obtained.

CLEANING AND MECHANICAL WORKING STEP

After container portions adhered to the surfaces of the secondary hot worked metal block are removed if necessary, the metal block is made into a semi-finished product, such as slab, billet and the like, and if necessary further subjected to another working or to a mechanical working in order to finish the semi-finished product into a final product.

In the present invention, raw material powder as such is subjected to the above described treating steps to obtain a finally worked metal block.

As described above, in the present invention, in order to interrupt air from raw material powder mainly during heating, carbonaceous powder is disposed in the inside of the metallic container or at the outside of the container.

Figure 3A:
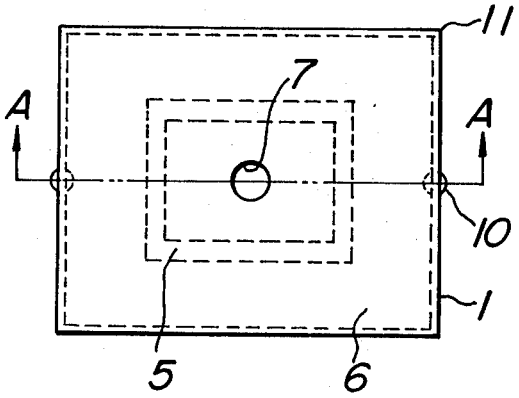
FIG. 3A is a plan view of one embodiment of a metallic container to be used in the method of the present invention.
Figure 3B:
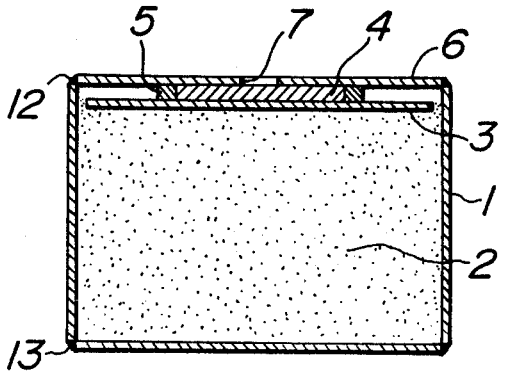
FIG. 3B is a vertical sectional view of the container shown in FIG. 3A taken on the line A–A′ in the arrow direction.

FIGS. 3A and 3B show one embodiment of the air-interrupting method, in which carbonaceous powder is disposed in the inside of the container. In this case, it is necessary that the carbonaceous powder and raw material powder are separated from each other so that they are neither brought into contact with each other nor incompletely mixed until a finally worked metal block is obtained.

As shown in FIGS. 3A and 3B, a partition plate 3 having a dimension corresponding to the inner dimension of the opening of a container 1 is placed on raw material powder 2. However, container 1 is not tightly closed by partition plate 3. Carbonaceous powder 4 is disposed on the central portion of the partition plate 3 and is surrounded with a frame 5. A metallic cover 6 having a gas hole 7 is fixed to the container 1. The gas hole 7 has been previously bored through the cover 6 so that the hole 7 substantially faces to central portion of the carbonaceous powder 4.

In this case, the frame 5 may be made of metal, wood, plastic, paper and the like. It has been found by experiments that wood is most easily handled.

Wooden frame is carbonized during heating, but still can retain the carbonaceous powder 4 on the partition plate 3 in its central portion. Another role of the frame 5 is to transmit an outer force, whose direction is perpendicular to the plane of the cover 6, from the cover 6 to the partition plate 3, whereby the raw material powder and the carbonaceous powder in the container are prevented from being moved.

Since the frame 5 is held between the cover 6 and the partition plate 3, it does not easily move. However, since the frame 5 seldom moves by impact force or other action, it is desirable to prevent the movement of the frame 5 by arranging a stopper on the partition plate 3 by various means.

Figure 4A:
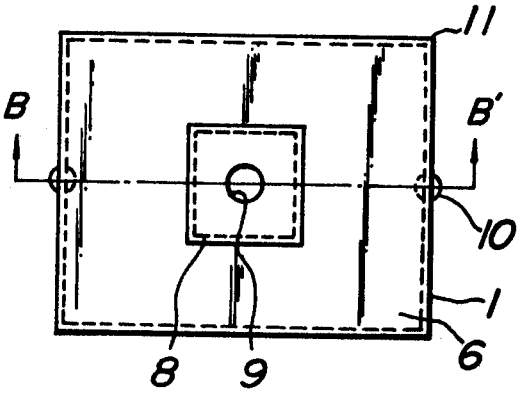
FIG. 4A is a plan view of another embodiment of a metallic container to be used in the method of the present invention.
Figure 4B:
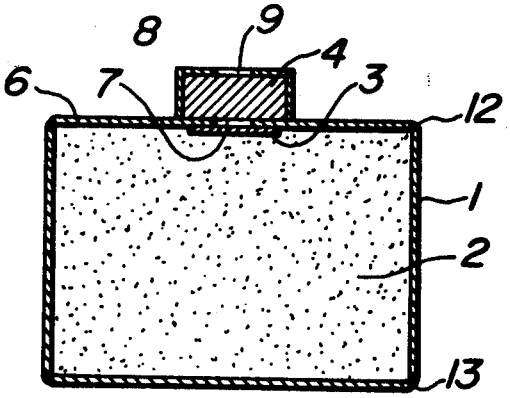
FIG. 4B is a vertical sectional view of the container shown in FIG. 4A taken on the line B–B′ in the arrow direction.

FIGS. 4A and 4B show another embodiment of the air-interrupting method, in which carbonaceous powder is charged in a cap and the cap is fixed to the outside of the container. In this case, raw material powder 2 is charged fully in a metallic container 1, and the container 1 is sealed with a cover 6. A gas hole 7 bored through the cover 6 is closed from the container side with a partition plate 3, which is arranged not to hinder the pass of gas. That is, a partition plate having an area as large as enough to cover the gas hole 7 is, for example, welded to the container side of the cover 6 in several portions facing to the gas hole 7, leaving unwelded portions. Alternatively, grooves communicating from the gas hole 7 to the inside of the container 1 are formed on the partition plate 3 at its contacting side with the cover 6.

Then, a metallic cap 8, which has an area as large as enough to cover the gas hole 7 formed through the cover 6 and has previously charged with carbonaceous powder 4, is placed on the cover 6, and fixed to the cover 6 by spot welding or other means at the peripheral portion of the cap 8. The cap 8 also is provided with a gas hole 9.

In both of the above air-interrupting methods, the cover 6 can be fixed to the metallic container 1 by any means, such as welding, press bonding, screwing and the like.

In the production of a metallic container 1 by the welding, when it is obliged to form a weld line along the direction parallel to the compression working direction during the hot workings, particularly during the primary hot working, it is necessary that the container 1 must be produced in such a manner that the welding line is formed at a position other than the edge of the container 1. When a weld line is formed at the edge, cracks occur in the welded edge at the primary hot working, and raw material powder 4 in the container 1 is oxidized. Accordingly, when it is intended to carry out primary hot working by applying a pressure in a direction perpendicular to the plane of a plan view shown by FIG. 3A or 4A, the container 1 is preferred to be produced by the butt welding at the center portion in the short side of the container 1, and must not be produced by the welding along the edge 11. However, edges 12 and 13 of a container 1, which are perpendicular to the pressing direction, may be formed by welding.

The following examples are given by the purpose of illustration of this invention and are not intended as limitations thereof.

Table 1 shows properties of the raw material powders used in the following examples.

Table 2 shows conditions of the preparation stage in the examples.

Table 3 shows conditions in the hot workings in the examples.

Table 4 shows properties of the finally worked metal block obtained in the examples.

Table 1

| | | | | | | | | Grain size distribution (wt. %) | | | | | |
|---|---|---|---|---|---|---|---|---|---|---|---|---|---|
| | | composition (wt. %) | | | | | | +100 meshes | 100 to 150 meshes | 150 to 200 meshes | 200 to 250 meshes | 250 to 325 meshes | −325 meshes |
| | Kind of raw material powder | C | Si | Mn | P | S | Cr | D | | | | | |
| Exam- | Iron powder obtained | 0.006 | 0.018 | 0.007 | 0.006 | 0 | 0.421 | 0.1 | 21.8 | 31.7 | 11.8 | 15.9 | 18.7 |

Table 1-continued

| | Kind of raw material powder | composition (wt. %) C | Si | Mn | P | S | Cr | D | Grain size distribution (wt. %) +100 meshes | 100 to 150 meshes | 150 to 200 meshes | 200 to 250 meshes | 250 to 325 meshes | −325 meshes |
|---|---|---|---|---|---|---|---|---|---|---|---|---|---|---|
| ple 1 | by reducing mill scale, apparent density 2.57 g/m$^3$ | | | | | | | | | | | | | |
| Example 2 | Mixture of 100 parts by weight of the iron powder used in Example 1 and 0.90 part of graphite powder | | | | | | | | | | | | | |
| Example 3 | Alloy steel powder obtained by water-atomization, apparent density 2.76 g/cm$^3$ | 0.47 | 0.014 | 0.65 | 0.007 | 0.011 | 1.06 | 0.130 | 0 | 18.0 | 24.2 | 10.9 | 27.6 | 19.3 |

Table 2

| | Example 1 | Example 2 | Example 3 |
|---|---|---|---|
| Container: | | | |
| Material | Hot rolled mild steel sheet, thickness 4.5 mm | Hot rolled mild steel sheet, thickness 4.5 mm | Hot rolled mild steel sheet, thickness 4.5 mm |
| Production method | Welding | Welding | Welding |
| Dimension | 330W × 330L × 220H(mm) | 120W × 200L × 170H(mm) | 120W × 200L × 170H(mm) |
| Carbonaceous powder: | | | |
| Kind and property | Scaly natural graphite, average grain size 10 μm, fixed carbon 99.5% | Scaly natural graphite, average grain size 10 μm, fixed carbon 99.5% | Scaly natural graphite, average grain size 10 μm, fixed carbon 99.5% |
| Disposed position | Outside of container | Inside of container | Inside of container |
| Amount | Volume 80W × 80L × 10H(mm) Weight 30 g | Volume 60W × 100L × 5H(mm) Weight 14 g | Volume 60W × 100L × 5H(mm) Weight 14 g |
| Raw material powder: | | | |
| Amount | 64 Kg | 8.3 Kg | 10.7 Kg |
| Charging method | Vibration charing | Natural charging | Vibration charging |
| Charging density | 3.03 g/cm$^3$ | 2.57 g/cm$^3$ | 3.27 g/cm$^3$ |

Note:
W: Width,
L: Length,
H: Height

Table 3

| | Example 1 | Example 2 | Example 3 |
|---|---|---|---|
| Primary heating: | | | |
| Furnace | Heavy oil furnace | Electric furnace | Electric furnace |
| Condition | 1,280° C × 90 min | 1,250° C × 40 min | 1,250° C × 40 min |
| Primary hot working: | | | |
| Machine | 1,000 ton hydraulic press using upper and lower halves die | 200 ton hydraulic press using upper and lower halves die | 200 ton hydraulic press using upper and lower halves die |
| Condition | Reduction rate 2.75 Working pressure 0.75 t/cm$^2$ | Reduction rate 2.83 Working pressure 0.70 g/cm$^2$ | Reduction rate 2.83 Working pressure 0.70 t/cm$^2$ |
| Dimension of primarily hot worked compact body | 360W × 360L × 80H(mm) | 150W × 230L × 60H(mm) | 150W × 230L × 60H(mm) |
| Relative density of primarily hot worked compact body | 94.2% | 87.7% | 86.5% |
| Secondary heating: | | | |
| Furnace | Heavy oil furnace | Heavy oil furnace | Electric furnace |
| Condition | 1,250° C × 40 min | 1250° C × 30 min | 1,250° C × 30 min |
| Secondary hot working: | | | |
| Machine | 3 ton air hammer | 1 ton air hammer | 200 ton hydraulic press |
| Condition | Reduction rate 2.0 | Reduction rate 2.0 | Reduction rate 2.0 |
| Dimension of secondary hot worked metal block | 500W × 570L × 40T(mm) | 220W × 300L × 30T(mm) | 220W × 340L × 30T(mm) |
| Relative density of secondary hot worked metal block | 99.7% | 99.3% | 99.8% |

Note:
All of heatings and hot workings were carried out in the air.

Table 4

| | Chemical composition (wt. %) C | Si | Mn | P | S | Cr | O | Heat Treatments | Mechanical properties Tensile strength (Kg/mm$^2$) | Elongation (%) | Reduction of area (%) | Impact value, 2 mmV Notch (Kg.m) |
|---|---|---|---|---|---|---|---|---|---|---|---|---|
| Example 1 | 0.010 | 0.020 | 0.25 | 0.006 | 0.007 | 0 | 0.311 | As forged | 31.2 | 30.6 | 64.1 | 3.8 |
| Example 2 | 0.56 | 0.019 | 0.26 | 0.007 | 0.007 | 0 | 0.044 | Quenching: 830° C × 60min, W.Q. Tempering: 600° C × 90min, W.C. Quenching: | 76.2 | 21.2 | 50.3 | 4.8 |

Table 4-continued

| | Chemical composition (wt. %) | | | | | | | Heat Treatments | Mechanical properties | | | |
|---|---|---|---|---|---|---|---|---|---|---|---|---|
| | C | Si | Mn | P | S | Cr | O | | Tensile strength (Kg/mm$^2$) | Elongation (%) | Reduction of area (%) | Impact value, 2 mmV Notch (Kg.m) |
| Example 3 | 0.40 | 0.015 | 0.64 | 0.007 | 0.011 | 1.05 | 0.089 | 850° C × 60min, W.Q. Tempering: 600° C × 90min, W.C. | 90.7 | 18.4 | 49.6 | 8.8 |

W.Q. Water quenching
W.C. Water cooling

EXAMPLE 1

Pure iron powder produced by reducing mill scale was used as a raw material powder. A container was produced by welding mild steel sheets. The raw material powder was charged in the container while vibrating the container, and graphite powder for interrupting oxygen was charged in a cap and disposed at the outside of the container as shown in FIGS. 4A and 4B.

The raw material powder was subjected to a primary heating at a temperature of 1,280° C. by a heavy oil furnace, and then subjected to a primary hot working with the use of an upper and lower halves die by means of a 1,000 ton hydraulic press. The primarily hot worked compact body was cooled to room temperature. The cap charged with the graphite powder was removed just before the primary hot working. A cap charged with graphite powder was again fixed to the container after the primary hot working, and the primarily worked compact body was subjected to a secondary heating. Then, the cap was removed, and the secondarily heated compact body was forged into a sheet by means of a 3 ton air hammer. In the above treatment, all of the heatings and hot workings were carried out in the air.

Properties of the sheet are not inferior to those of a sheet produced from ingot iron. The oxygen content of the sheet is less than that of the raw material powder.

The resulting sheet was able to be used in the liner plate for rolling mill taking in the place of the one being made of high-strength brass, lead bronze and the like.

EXAMPLE 2

A homogeneous mixture of the pure iron powder used in Example 1 and graphite powder was used as a raw material powder. A container produced by welding mild steel sheets was used similarly to Example 1, and graphite powder for preventing oxidation was disposed in the inside of the container.

A primary heating was carried out in the air by an electric furnace and a secondary heating was carried out in the air by a heavy oil furnace. A primary hot working was carried out with the use of a upper and lower halves die by means of a 200 ton hydraulic press. A secondary hot working was carried out in a free forging system by means of one ton drop hammer.

The finally worked metal block is excellent in the strength and toughness and is wholly homogeneous. The oxygen content of the finally worked metal block is about 1/10 of that of the raw material powder. When the resulting sheet was mechanically worked, the sheet was able to be advantageously used as a backing strip for welding spiral steel tubes.

EXAMPLE 3

An alloy steel powder produced by water-atomization was charged in a mild steel container produced by welding, while vibrating the container. After graphite powder was disposed in the inside of the container, the alloy steel powder was subjected to the treating steps of the present invention. Both of primary and secondary heatings were carried out in the air by electric furnaces. A primary hot working was carried out with the use of an upper and lower halves die by means of a 200 ton hydraulic press, and a secondary hot working was carried out without the use of die by means of a 200 ton hydraulic press in such a manner that the primarily hot worked compact body was reduced from place to place.

The finally worked metal block is excellent in the strength and toughness, and is lower than the starting alloy steel powder in the oxygen content. Moreover, segregation of the components and unevenness in structure are not observed in the entire portion of the metal block.

As described above, according to the present invention, raw material powder in the solid phase state is directly hot worked into a metal block having a high density without melting the powder. Therefore, the metal block has not drawbacks, such as solidification, segregation, internal defect, unevenness in structure, localization of nonmetallic inclusions, which are inevitable in the metal block produced from ingot raw material. Further, according to the present invention, a metal block having uniformly dispersed heterogeneous phase can easily be produced, while the same can be produced from ingot raw material only with difficulties. Moreover, according to the present invention, raw metal powder can be directly hot worked in the air, and therefore metal block having a high density can be produced through very simple production steps.

What is claimed is:

1. A method of producing a high density metal block comprising, charging raw material powder into a metallic container, said raw material comprising metal powder having a particle size of not larger than 1 mm, placing a partition plate on the raw metal powder, disposing carbonaceous powder on top of said partition plate, the latter preventing the carbonaceous powder from directly contacting the raw material powder, said carbonaceous powder heating, generating and maintaining an oxidation protecting atmosphere, disposing a metallic cover having a gas hole therein on said container to form an enclosure with said partition plate, uniformly heating the contained raw material powder in atmospheric air at a temperature within the range (M.P. × 0.67)° C. to (M.P. − 50° C.), where M.P. is the melting point in degrees Centigrade at which the raw material powder begins to melt, subjecting the heated container and raw material powder to a primary hot working step in atmospheric air to obtain a hot worked compact body having a relative density of 64–96% of the theoretical density, said primary hot working consisting of compressing the contained raw material to achieve a reduction ratio of 1.5–2.0, said compressing being carried out without restraining the pressure-free side walls of the container, and further compressing the contained raw material powder to achieve a total reduction ratio, inclusive of said 1.5–2.0, of less than 5.6, said further compressing being carried out while restraining said side walls, subjecting the said primarily hot worked compact body to a secondary hot working to obtain a secondarily worked metal block having a relative density of 95–100% of the theoretical density, said secondary hot working consisting of compressing the primarily hot worked compact to achieve a reduction ratio of at least 1.5 or a reduction in sectional area of at least 30%.

2. A method according to claim 1, wherein said raw material powder is metal powder.

3. A method according to claim 2, wherein said metal powder includes metals, metal alloys and their mixtures.

4. A method according to claim 1, wherein said raw material powder is a mixture of said metal powder and nonmetal powder, the amount of said nonmetal powder being 0–10% by weight based on the amount of the mixture.

5. A method according to claim 4, wherein said nonmetal powder is graphite powder.

6. A method according to claim 1, wherein said carbonaceous powder is natural graphite.

7. A method according to claim 1, wherein the carbonaceous powder is used in an amount that the height of the powder is 1/100–1/20 based on the height of the container and the area occupied by the powder is 5–65% based on the inner cross-sectional area of the container.

8. A method according to claim 1, wherein said uniform heating of raw material powder is effected at a temperature from (M.P.×0.80)° C. to (M.P.−50)° C.

9. A method according to claim 1, wherein said primary hot working is effected at a total reduction ratio of 2.3–3.2 inclusive of the reduction ratio in the first half and that in the latter half of the working.

10. A method according to claim 1, further comprising, disposing carbonaceous powder on a central portion of said partition plate, the latter being placed on top of the raw metal powder, surrounding the carbonaceous powder with a frame disposed upon said partition plate, and disposing a metal cover having gas holes therein on said frame to form an enclosure which prevents the carbonaceous powder from being moved and to retain the same within a central portion of said partition plate.

11. A method according to claim 1, further comprising, charging the raw material powder into a metallic container up to its upper end, welding said metallic cover by spot welding in several portions to a metal partition plate, having an area large enough to cover the gas hole, to form a gap between the cover and the partition plate, so that gas can flow into or out from the container through the gap, covering the container with said cover in such a manner that the partition plate is positioned within the container, sealing the container with the cover by welding the periphery of the cover to the container, and spot welding a metallic cap, which has an area large enough to cover the gas hole, and which has previously been charged with carbonaceous powder, to the cover, so as to cover the gas hole.

* * * * *